US006508411B1

(12) United States Patent
Ohnishi et al.

(10) Patent No.: US 6,508,411 B1
(45) Date of Patent: Jan. 21, 2003

(54) METHOD OF DRIVING LIQUID-DROP SPRAYING DEVICE

(75) Inventors: Takao Ohnishi, Nishikasugai-gun (JP); Iwao Ohwada, Nagoya (JP); Toshikazu Hirota, Kuwana (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 09/701,552

(22) PCT Filed: Mar. 30, 2000

(86) PCT No.: PCT/JP00/02018

§ 371 (c)(1),
(2), (4) Date: Jan. 8, 2001

(87) PCT Pub. No.: WO00/58626

PCT Pub. Date: Oct. 5, 2000

(30) Foreign Application Priority Data

Mar. 31, 1999 (JP) ..... 11-092906
Aug. 23, 1999 (WO) ..... PCT/JP99/04523

(51) Int. Cl.[7] ..... B05B 17/04

(52) U.S. Cl. ..... 239/4; 239/1; 239/5; 239/102.1; 239/102.2

(58) Field of Search ..... 239/1, 4, 5, 102.1, 239/102.2

(56) References Cited

U.S. PATENT DOCUMENTS 4,188,635 A * 2/1980 Giordano et al. ..... 347/75
4,388,343 A * 6/1983 Voss et al. ..... 239/4
5,248,087 A * 9/1993 Dressler ..... 239/102.2
5,823,428 A * 10/1998 Humberstone et al. .. 239/102.2
5,938,117 A * 8/1999 Ivri ..... 239/102.2

FOREIGN PATENT DOCUMENTS

JP 04-039060 A 2/1992
JP 08-300646 11/1996
JP 10-107335 4/1998

* cited by examiner

*Primary Examiner*—Robin O. Evans
(74) *Attorney, Agent, or Firm*—Burr & Brown

(57) ABSTRACT

A liquid-drop spraying device is provided which can perform a stable liquid discharge without producing air bubbles in the liquid of the pressurized room as well as the amount of liquid supply per unit time is increased. The liquid can be flowed into the pressurized room uniformly and without entrainment of bubbles from the nozzle side by making an initial discharge (or charge) time constant larger than a subsequent discharge (or charge) time constant, which in turn allows liquid in the pressurized room to be replaced by slow suction followed by fast suction.

4 Claims, 5 Drawing Sheets

| DRIVE VOLTAGE | SWITCHED VOLTAGE | STABILITY |
|---|---|---|
| 40V | 30V (75%) | Δ |
| 40V | 25V (63%) | O |
| 40V | 20V (50%) | O |
| 40V | 15V (38%) | O |
| 40V | 10V (25%) | Δ |

METHOD OF DRIVING LIQUID-DROP SPRAYING DEVICE

BACKGROUND OF THE INVENTION

1. Field of the Invention

The present invention relates to a method of driving a liquid-drop spraying device for use in various kinds of machines for processing the above described liquid-drop by means of discharging the liquid-drop. The present invention is particularly useful as a liquid discharging device upon drying process of various liquid raw materials which are required for stable liquid discharges, and is preferable as a discharging device for various liquid, such as a liquid discharging device upon drying a solution including product aiming at supplying reactive raw materials such as pharmaceutical synthesis and powder production.

2. Description of the Prior Art

As for a conventional method of driving a liquid-drop spraying device, in a driving device for a liquid-drop spraying device comprising a plurality of minimal liquid-drop discharge units having respectively pressure means for discharging a liquid, a pressurized room for pressurizing discharge liquid, a nozzle for liquid discharge connected to the pressurized room, an inlet hole for supplying a liquid into the pressurized room, the foregoing inlet holes for supplying liquid of a plurality of liquid drop discharge units adjacent to each other being connected through a common liquid supplying path, and having the relevant piezoelectric\electrostriction element in a portion of a wall portion of the relevant liquid pressurized room, there has been a conventional method of driving a liquid-drop spraying device, in which the wall portion of the relevant liquid pressurized room is deformed by applying a predetermined voltage signal (charging or discharging) to the relevant piezoelectric\electrostriction element, hence, a liquid supplied to the relevant liquid pressurized room is sprayed from the foregoing nozzle by the pressure produced in the relevant liquid pressurized room, and a liquid is supplied from the inlet hole to the pressurized room by recovering the distortion of the relevant liquid pressurized room to the original form.

Then, depending upon a kind of liquid drop processing device mounted on a liquid drop spraying device, there is a device for use in supplying a large amount of liquid, a large amount of liquid is supplied by enlarging aperture of a nozzle hole and inlet hole.

However, in the case where an aperture of a nozzle hole is made too large, discharging liquid cannot be a minimal liquid-drop. Neither, as for an inlet hole, since an inlet hole not only has a function as a path through which the liquid is supplied into the pressurized room, but also has a function preventing back flow even if pressurized at the time when a liquid is sprayed from nozzle hole, the aperture of the hole cannot be widened to unlimited. Therefore, although the number of times of application per unit time period is increased and an amount of supplying volume of liquid is increased by shortening an interval time period of applying a predetermined voltage signal to piezoelectric\electrostriction element, since liquid supply from an inlet hole to a pressurized room is delayed, it cannot be carried out to stably supply a larger amount of the liquid.

DISCLOSURE OF THE INVENTION

As for a method of driving a liquid-drop spraying device according to the present invention, in a liquid-drop spraying device comprising a plurality of minimal liquid-drop discharge units respectively having a nozzle for liquid discharge, a pressurized room for pressurizing a liquid made discharge from the relevant nozzle, an inlet hole supplying a liquid into the relevant pressurized room and piezoelectric\electrostriction element making the relevant pressurized room pressurize and operate, the foregoing liquid inlet holes of a plurality of liquid-drop discharge units being connected to a common liquid supplying path, a method of driving a liquid-drop spraying device according to the present invention is provided, in which a wall portion of the foregoing pressurized room is deformed by repeatedly applying a predetermined voltage signal to the foregoing piezoelectric\electrostriction element, thereby spraying a liquid supplied into the relevant pressurized room from the foregoing nozzle by the pressure produced in the pressurized room, characterized in that the ratio of the foregoing inlet hole aperture to the foregoing nozzle hole aperture (inlet hole aperture/nozzle hole aperture) ranges from equal to or more than 0.6 to equal to or less than 1.6, and the ratio of the nozzle hole aperture and the nozzle thickness (nozzle hole aperture/nozzle thickness) ranges from equal to or more than 0.2 to equal to or less than 4, after the foregoing applying voltage signal supplies and charges the current from starting charge voltage to the foregoing piezoelectric\electrostriction element, retaining final charge voltage during certain time period, and then discharges having more than 2 kinds of discharge time constants are in turn performed, and the initial first discharge time constant is larger than the next second discharge time constant, making the foregoing starting charge voltage as a reference, the second discharge is started with voltage ranges from equal to or more than 35% to equal to or less than 70% of voltage difference between the foregoing starting charge voltage and the foregoing final charge voltage.

The present invention effectively acts when discharging on a liquid having a low viscosity, concretely, a liquid having a viscosity of 0.2 mPa/S–30 mPa·S, preferably a liquid having a viscosity of 0.5 mPa/S–1.2 mPa/S, in the case where liquid-drops are discharged from a plurality of liquid-drop discharge units at the same time according to the above described constitution, when a liquid is supplied from a liquid inlet hole into a liquid pressurized room after liquid discharge, since it performs rapidly suctioning the liquid having started to move than at the first suction speed and smoothly supplying the liquid and in a short time into the liquid pressurized room after first comparatively slowly suctioning the liquid and flowing the liquid into the whole inlet holes, a stable discharge of liquid can be carried out without producing bubbles in the liquid of the liquid pressurized room as well as an amount of liquid supplying per unit time period is increased.

Moreover, rapid pressure variation within pressurized room is avoided by retaining final charge voltage during certain time period immediately after discharging liquid-drop and that bubbles entering into a pressurized room from a nozzle by vibration of liquid level in a nozzle for liquid discharge is avoided, but immediately after starting discharge voltage, liquid vibration in a nozzle for liquid discharge is still remained. Hence, during the foregoing vibration is remained, discharge time constant is made larger, then suctioning the liquid by slow pressure variation, consequently when the foregoing vibration has been attenuated, if discharge is rapidly performed at the second discharge time constant, entrainment of bubbles from the nozzle for liquid discharge into the pressurized room by pressure variation of discharge time can be prevented, time interval of applying a predetermined voltage signal can be shortened to piezoelectric\electrostriction element and an amount of liquid supply can be increased since discharge at the second discharge time constant is rapidly performed.

Furthermore, voltage starting discharge at the second discharge time constant is preferably made ranged from equal to or more than 35% to equal to or less than 70% of voltage difference between starting charge voltage and final charge voltage, making starting discharge voltage as a reference.

When the starting discharge voltage is equal to or less than 35%, since discharge whose discharge time constant is large, i.e., suction which is slowly performed occupies most of all suctioning steps, suction itself is securely performed, however, an amount of suction per unit time period is not taken large, since a discharge period cannot be shortened as a result, a large amount of discharge cannot be secured. Moreover, in the case where suction time is taken comparatively smaller in the situations of the range of the first discharge time constant being larger than that of the second discharge time constant so as to take a larger amount of suction per unit time period, the starting of suction is unstable, and incomplete discharge will be occurred. Furthermore, when the second starting discharge voltage is equal to or more than 70%, since discharge whose discharge time constant is large, i.e., the rate of slow suction is too small, starting of liquid suction cannot be rapidly performed, an amount of suction of liquid from the liquid inlet hole to the liquid pressurized room is decreased, entrainment of bubbles from the nozzle for liquid discharge will be occurred and spraying will be unstable.

Moreover, upon discharging in the foregoing drive waveform, in the case where the ratio of the supplying hole aperture to the nozzle hole aperture (inlet hole aperture/nozzle hole aperture) is larger, if the suction is considered, it will be well-directed, however, since the rate of the pressure upon discharge being escaped to the side of inlet hole aperture is large, discharge power will be insufficient. Moreover, in the case where it is smaller, since an amount of insufficient supply with respect to an amount of discharge is occurred, the ratio of the inlet hole aperture to the nozzle hole aperture (inlet hole aperture/nozzle hole aperture) is preferably between 0.6 and 1.6.

Furthermore, the ratio of the nozzle hole aperture to nozzle thickness (nozzle hole aperture/nozzle thickness) preferably ranges from equal to or more than 0.2 to equal to or less than 4, in the case where the ratio of the nozzle hole aperture to the nozzle thickness (nozzle hole aperture/nozzle thickness) is equal to or less than 4, residual vibration of liquid level immediately after liquid discharge can be rapidly converged by contact resistance with fluid on the wall of discharge hole, furthermore, an invasion of bubbles into the pressurized room by pressure variation within pressurized room upon discharge can be prevented, spraying stability can be enhanced, the liquid can be discharged in a shorter time period as a result, and an amount of spraying can be increased.

Moreover, in the case where the ratio of the nozzle hole aperture to nozzle thickness (nozzle hole aperture/nozzle thickness) is equal to or more than 0.2, since the contact resistance with the fluid on the wall of discharge hole is large, the occurrence of incomplete discharge due to the insufficiency of discharge force is prevented. Furthermore, when three of the foregoing ratio of the inlet hole aperture to the nozzle hole aperture, the foregoing ratio of the nozzle hole aperture to the nozzle thickness and the foregoing voltage of the second starting discharge has been fulfilled simultaneously, incomplete spraying due to an invasion of bubbles is prevented, and a large amount of spraying could have been secured.

Moreover, it is preferable that in the above described constitution, a time ranging from the time when piezoelectric\electrostriction element has started discharge with the second discharge time constant to the time when the next predetermined voltage signal is applied (T4), is made ranged from equal to or more than one fourth to equal to or less than 20 fold of specific vibration period (T) at the time when a liquid is supplied to the channel path within the structure constituted of a nozzle for liquid discharge, a pressurized room for pressurizing a liquid to discharge it from the relevant nozzle, an inlet hole for supplying a liquid into the relevant pressurized room and a piezoelectric\electrostriction element for making the relevant pressurized room pressurize and operate, and the ratio (T3/T4) of a time discharging at the first discharge time constant (T3) to the time ranging from the time when discharge has been started at the second discharge time constant to the time when the next predetermined voltage signal is applied to the piezoelectric\electrostriction element (T4) is made ranged from equal to or more than 0.1 to equal to or less than 20 fold.

In the case where the time ranging from the time when the piezoelectric\electrostriction element has started discharge at the second discharge time constant to the time when the next predetermined voltage signal is applied (T4) is equal to or less than one fourth of the specific vibration period (T), since suction speed of a liquid from a liquid inlet hole into the liquid pressurized room after liquid discharge is too high, even if the first discharge has started without discrepancy, the liquid supply from the inlet hole is insufficient in time at the time of suction during the second discharge, an invasion of bubbles from the nozzle hole for the liquid discharge into the pressurized room makes it incomplete spraying. Moreover, in the case where the above described T4 is equal to or more than 20 fold of T, since an amount of suction per unit time period is not taken large, discharge period cannot be shortened as a result and a large amount of discharge cannot be secured.

Furthermore, in the case where the ratio of the time discharging at the first discharge time constant (T3) to the time ranging from the time when discharge has been started at the second time constant to the time when the next predetermined voltage signal is applied to the piezoelectric\electrostriction element (T4) is equal to or less than 0.1, since the rate of the first discharge which has a large time constant is small, the ratio of an amount of suction of the liquid during the first discharge with respect to the whole amount of suction is decreased, suction cannot be sufficient at the time of suction during the second discharge and the invasion of bubbles from the nozzle hole for the liquid discharge into the pressurized room may make it incomplete spraying. Moreover, in the case where the above described ratio is equal to or more than 20, since an amount of suction per unit time period is not taken large, discharge period cannot be shortened as a result, and a large amount of discharge cannot be secured.

Moreover, in a form of spraying a liquid-drop during discharge of the foregoing piezoelectric\electrostriction element, the present invention is a method of driving a liquid-drop spraying device in which a wall portion of a pressurized room is deformed by applying different voltage signals repeatedly to the piezoelectric\electrostriction element to which a predetermined voltage signal has been applied, thereby the liquid supplied into the relevant pressurized room is sprayed from the foregoing nozzle by a pressure produced in the pressurized room, characterized in that the ratio of the foregoing inlet hole aperture to the foregoing nozzle hole aperture (inlet hole aperture/nozzle hole aperture) ranges from equal to or more than 0.6 to equal to or less than 1.6, and the ratio of the nozzle hole aperture to the nozzle thickness (nozzle hole aperture/nozzle thickness) ranges from equal to or more than 0.2 to equal to or less than 4, after the foregoing different applying voltage signal has discharged the current from the foregoing piezoelectric\electrostriction element to which the starting discharge voltage has been applied, the final discharge voltage during certain time period is retained, consequently, in turn, charges having equal to or more than two kinds of charge time constants are performed, and the starting first charge time constant is larger than the next second charge time constant, the second charge is started with the voltage ranging from equal to or more than 30% to equal to or less than 65% of the voltage difference between the foregoing final discharge voltage and the foregoing starting discharge voltage, and making the foregoing final discharge voltage as a reference.

In the case where liquid-drops are discharged simultaneously from a plurality of liquid-drop discharge units according to the above described constitution, when the liquid is supplied from the liquid inlet hole into the liquid pressurized room following liquid discharge, since after the liquid is first comparatively slowly suctioned and the liquid is flowed into the whole inlet holes, the liquid having started to move is suctioned rapidly than at the first suction speed and the liquid supply is performed smoothly and in a shorter time into the liquid pressurized room, a stable liquid discharge can be performed without making production of any air bubble in the liquid of the liquid pressurized room as well as an amount of the liquid supply per unit time period is increased.

Moreover, although immediately after liquid-drop discharge, abrupt pressure variation within the pressurized room is avoided by retaining final discharge voltage during certain time period, and entering of bubbles from the nozzle into the pressurized room due to the vibration of the liquid level in the nozzle for a liquid discharge is avoided, immediately after starting charge, the vibration of the liquid level in the nozzle for the liquid discharge remains. Therefore, during the foregoing vibration remains, the charge time constant is made large, the liquid is suctioned with slow pressure variation, consequently, when the foregoing vibration has been attenuated, if charge is rapidly performed with the second charge time constant, the entrainment of bubbles from the nozzle for the liquid discharge into the pressurized room due to the pressure variation during charge can be prevented, and since charge with the second charge time constant is rapidly performed, a time interval for applying a predetermined voltage signal to the piezoelectric\electrostriction element can be shortened and an amount of liquid supply can be increased.

Furthermore, it is preferable that the voltage starting charge with the second charge time constant is made ranged from equal to or more than 30% to equal to or less than 65% of the voltage difference between the final discharge voltage and the starting discharge voltage, making the final discharge voltage as a reference.

In the case where the starting charge voltage is equal to or more than 65%, although the discharge whose discharge time constant is large, i.e., the suction which is slowly performed occupies most of all suction steps, the suction itself is securely performed, since an amount of suction per unit time period is not taken large, discharge period cannot be shortened as a result, a large amount of discharge cannot be secured. Moreover, if the suction time is taken comparatively smaller in the situations of the range of the first charge time constant being larger than that of the second charge time constant so as to take a larger amount of suction per unit time period, the starting of suction will be unstable and incomplete discharge will be occurred. Moreover, in the case where it is equal to or less than 30%, since the rate of the charge whose charge time constant is large, i.e., the suction which is slowly performed is too small, the starting of suction of the liquid cannot be rapidly performed, an amount of suction from the liquid inlet hole into the pressurized room following liquid discharge is decreased, and spraying is unstable because the entrainment of bubbles from the nozzle for the liquid discharge occurs.

Moreover, in the case where discharge is performed in the above described drive waveform, if the ratio of the supplying hole aperture to the nozzle hole aperture (inlet hole aperture/nozzle hole aperture) is larger, it will be lead to a good direction in the consideration of suction, however, since the rate of the pressure at the discharge being escaped to the side of inlet hole, discharge force will be insufficient. Moreover, in the case where the ratio is smaller, since the insufficiency of an amount of supply with respect to an amount of discharge is occurred, it is preferable that the ratio of the inlet hole aperture to the nozzle hole aperture (inlet hole aperture/nozzle hole aperture) ranges from equal to or more than 0.6 to equal to or less than 1.6.

Furthermore, it is preferable that the ratio of the nozzle hole aperture to the nozzle thickness (nozzle hole aperture/nozzle thickness) ranges from equal to or more than 0.2 to equal to less than 4, in the case where the ratio of the nozzle hole aperture to the nozzle thickness (nozzle aperture/nozzle thickness) is equal to or less than 4, residual vibration of the liquid level immediately after liquid discharge can be rapidly converged by the contact resistance with the fluid on the wall face of discharge hole, furthermore, the invasion of bubbles into the pressurized room due to the pressure variation within the pressurized room during charge can be prevented, the spraying stability can be enhanced, discharge can be performed in a shorter time period as a result, and an amount of spraying can be increased. Moreover, in the case where the ratio of the nozzle hole aperture to the nozzle thickness (nozzle hole aperture/nozzle thickness) is equal to or more than 0.2, since the contact resistance with the fluid on the wall face of the discharge hole is large, the occurrence of incomplete discharge due to the insufficiency of the discharge force can be prevented.

Furthermore, when the three of the above described ratio of inlet hole aperture to the nozzle hole aperture, the ratio of the nozzle hole aperture to the nozzle thickness and the second starting charge voltage have been fulfilled simultaneously, incomplete spraying due to the invasion of bubbles can be prevented and a large amount of spraying can be secured.

Moreover, it is preferable that in the above described constitution, a time ranging from the time when piezoelectric\electrostriction element has started discharge at the second discharge time constant to the time when the next predetermined voltage signal is applied (T40), is made ranged from equal to or more than one fourth of T to equal to or less than 20 T of specific vibration period (T) at the time when a liquid is supplied to the channel path within the structure constituted of a nozzle for liquid discharge, a pressurized room for pressurizing a liquid to discharge from the relevant nozzle, an inlet hole supplying a liquid into the relevant pressurized room and a piezoelectric\electrostriction element for making the relevant pressurized room pressurize and operate, and the ratio (T30/T40) of a time for discharging at the first discharge time constant (T30) to the time ranging from the time when discharge has been started at the second discharge time constant to the time when the next predetermined voltage signal is applied to the piezoelectric\electrostriction element (T40) is made ranged from equal to or more than 0.1 to equal to or less than 20.

In the case where the time ranging from the time when the piezoelectric\electrostriction element has started discharge at the second discharge time constant to the time when the next predetermined voltage signal is applied (T40) is equal to or less than one fourth of the specific vibration period (T), since suction speed of a liquid from a liquid inlet hole into the liquid pressurized room after liquid discharge is too high, even if the first discharge has started without discrepancy, the liquid supply from the inlet hole is insufficient in time at the time of suction during the second discharge, an invasion of bubbles from the nozzle hole for the liquid discharge into the pressurized room makes it incomplete spraying. Moreover, in the case where the above described T40 is equal to or more than 20 fold of T, since an amount of suction per unit time is not taken large, discharge period cannot be shortened as a result and a large amount of discharge cannot be secured.

Furthermore, in the case where the ratio of the time for discharging with the first discharge time constant (T30) to the time ranging from the time when discharge has been started at the second time constant to the time when the next predetermined voltage signal is applied to the piezoelectric\electrostriction element (T40) is equal to or less than 0.1, since the rate of the first discharge which has a large time constant is small, the ratio of an amount of suction of the liquid during the first discharge to the whole amount of suction is decreased, suction cannot be sufficient at the time of suction during the second discharge and the invasion of bubbles from the nozzle hole for the liquid discharge into the pressurized room may make it incomplete spraying. Moreover, in the case where the above described ratio is equal to or more than 20, since an amount of suction per unit time period is not taken large, discharge period cannot be shortened as a result, and a large amount of discharge cannot be secured.

BRIEF DESCRIPTION OF THE DRAWINGS

FIG. 4(*a*) shows measurement data, and FIG. 4(*b*) is an illustration showing applying voltage signals.

BEST MODE FOR CARRYING OUT THE INVENTION

Figure 1:
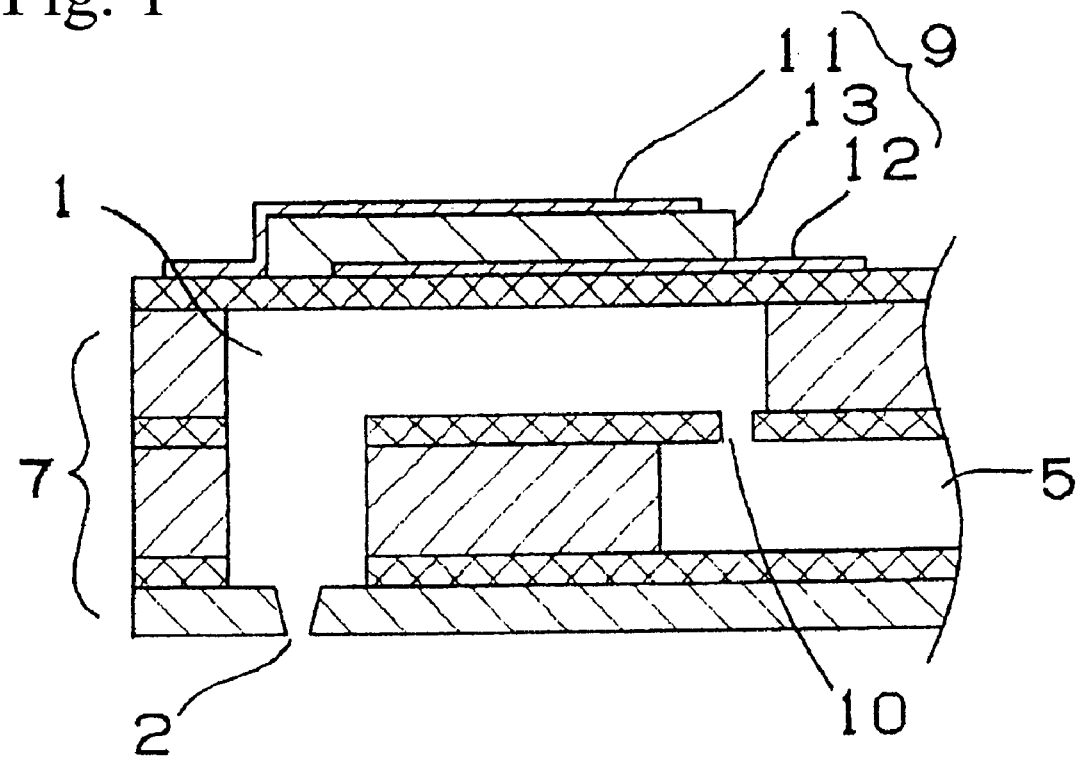
FIG. 1 is an illustration showing a vertical sectional view in center of a liquid-drop discharge unit of a liquid-drop spraying device.

Mode for carrying out a liquid-drop spraying device of the present invention will be described below on the basis of the drawings. FIG. 1 shows an example of a liquid-drop spraying device, and is an illustration showing vertical sectional view in center of a liquid-drop discharge unit. A liquid-drop spraying device has a plurality of units ranging from a few units to a few hundreds units of a liquid-drop discharge unit 7 having pressurizing means for discharging a liquid, a pressurized room 1 for pressurizing a liquid of discharging, a nozzle for a liquid discharge 2 connected to the lower portion of the pressurized room 1 and discharging a liquid to the processing portion of the liquid-drop spraying device and an inlet hole 10 supplying a liquid into the pressurized room 1 as one unit corresponding to an aspect of the use.

The liquid-drop discharge unit 7 in which a plurality of the pressurized room 1 and the pressurized room 1 adjacent each other are connected through a common liquid supplying path 5 via an inlet hole 10 has a piezoelectric\electrostriction element 9 as a pressurizing means in a portion of the upper wall portion of the pressurized room 1. The piezoelectric\electrostriction element 9 is consisted of laminating an upper electrode 11, a piezoelectric\electrostriction layer 13 and a lower electrode 12, wherein by applying a predetermined voltage signal, the piezoelectric\electrostriction layer 13 is deformed through an electric field produced between the upper electrode 11 and the lower electrode 12, a liquid supplied into the pressurized room 1 is sprayed from a nozzle 2 by the pressurizing force produced in the pressurized room 1 through deforming the wall portion of the fastened pressurized room 1.

Then, the ratio of the pressurized 10 to the nozzle hole 2 (inlet hole aperture/nozzle hole aperture) is made between 0.6–1.6, for example, 1.0, and the ratio of the nozzle hole aperture to the nozzle thickness (nozzle hole aperture/nozzle thickness) is made between 0.2–4, for example, 2. Discharge force and suction force will be well balanced by making the ratio of the inlet hole 10 to the nozzle hole 2 within the above described range, there is no insufficiency of discharge force and suction force.

It should be noted that it works well with respect to suction when exceeding over 1.6 but the rate of the pressure escaping to the side of the inlet hole at the time of discharge becomes large, resulting in insufficiency of discharge force. Moreover, when the ratio is smaller than 0.6, insufficiency of an amount of supplying with respect to an amount of discharge occurs. Furthermore, by making the ratio of the nozzle hole aperture/the nozzle thickness 0.2–4, if the ratio is equal to or less than 4, the residual vibration of liquid level immediately after liquid discharge can be rapidly converged by the contact resistance with the fluid on the wall face of the discharge hole, furthermore, the invasion of bubbles within the pressurized room due to the pressure variation within the pressurized room during discharge is prevented, the spraying stability can be enhanced, discharge can be performed in a shorter time period as a result and an amount of spraying can be increased, if the ratio is equal to or more than 0.2, since the contact resistance with the fluid on the wall face of discharge hole, the occurrence of incomplete discharge due to the insufficiency of discharge force can be prevented.

Moreover, the nozzle hole aperture in the above described mode for carrying out ranges from 25 μm to 100 μm.

Figures 2A, 2B:
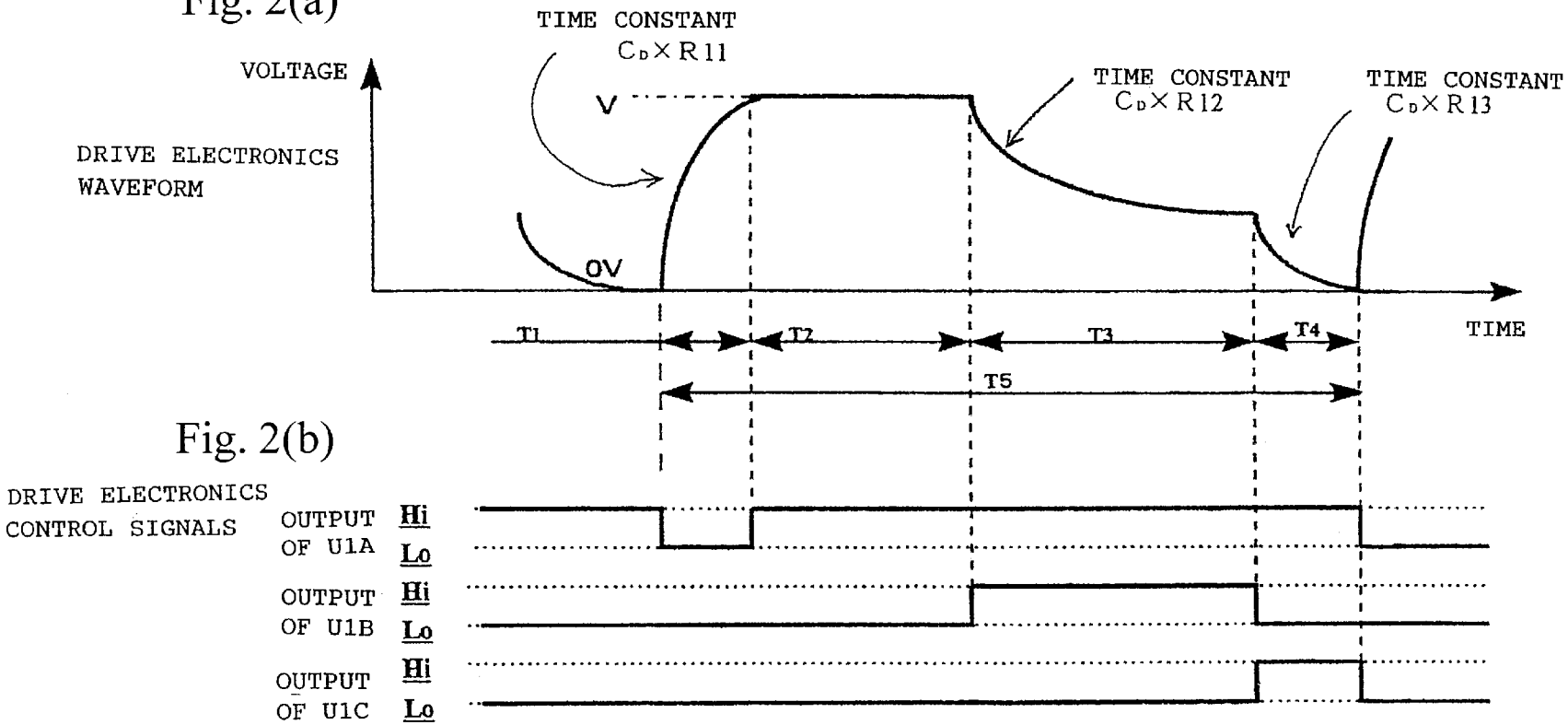
FIG. 2 is a graphical representation showing voltage waveform and a control signal of a drive electronics of a piezoelectric\electrostriction element along with the passage of time.

FIG. 2(*a*) is a graphical representation by passage of time showing voltage signals applying to the piezoelectric\electrostriction element 9 in the case where a liquid-drop is sprayed during charge of the piezoelectric\electrostriction element. A time T1 is a build-up time that a liquid is discharged from the nozzle 2 by the piezoelectric\electrostriction element 9 pressurizing the pressurized room 1 through supplying current and charging the piezoelectric body, and a time T2 is a retaining time for retaining final voltage in order to maintain a state of having completed discharge of a liquid during certain time period. A time T3, T4 is a fall time for performing in turn discharges having different time constants, since the initial first discharge time constant is larger than the next second discharge time constant, the liquid can be flowed into the pressurized room 1 uniformly from a plurality of inlet holes without entrainment of any bubble from the side of the nozzle by suctioning the liquid from the inlet hole 10 at the slow supplying speed following liquid discharge. Then, since as for the liquid having started to move, the liquid can be rapidly suctioned with the second discharge time constant which is smaller one, the liquid supply can be performed smoothly and in a shorter time period of a driving period time T5 comparing with the case where the liquid is suctioned to the last with the first time constant, thereby enabling a stable and a large amount of liquid discharge per unit time period.

Figures 4A, 4B:
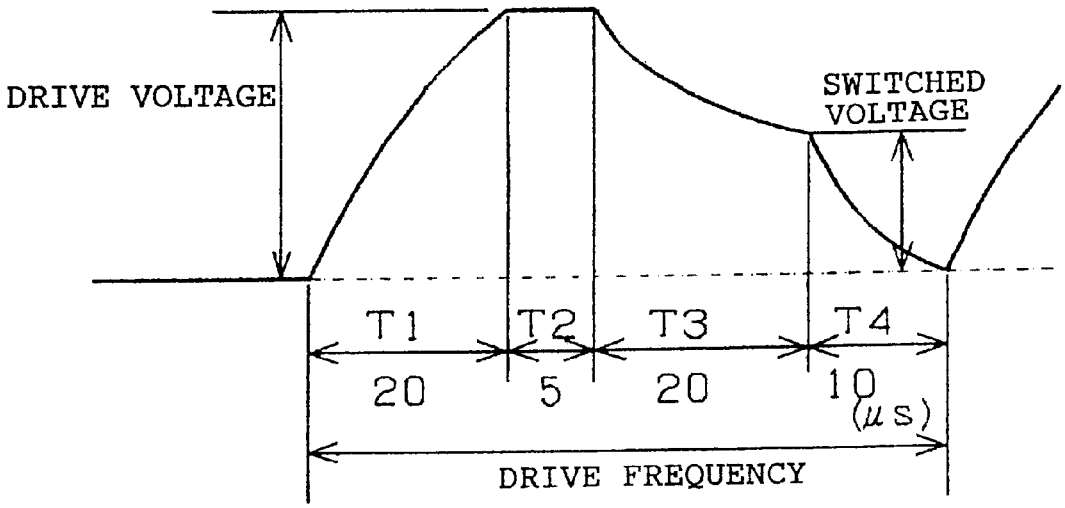
FIG. 4 is a graphical representation with measurement data showing a study of the stability of a liquid-drop spraying device by varying a voltage migrating from discharge using the first discharge time constant to discharge using the second discharge time constant.

FIG. 4 is a graphical representation with measurement data showing the results of studying the stability of discharge operation of a liquid-drop spraying device by varying voltage so as to migrate a discharge performed with the first discharge time constant to a discharge performed with the second discharge time constant, supposing that the drive voltage of the piezoelectric\electrostriction element is 40 V as being constant and T1=20 μs, T2=5 μs, T3=20 μs and T4=10 μs as being constant, FIG. 4(*a*) shows measurement data, and FIG. 4(*b*) shows an illustration of the passage of time concerning with applying voltage signals.

As shown in this Figure, although discharge operation is performed well in the case where the migration voltage causing discharge with the second time constant is between 38% and 63% of final charge voltage, discharge operation is not shown to perform well at 25% and 75% of final charge voltage. Thus, there is a range of voltage starting the second discharge, it is preferable to start the second discharge with voltage of 35%–70% of applying voltage, i.e., final charge voltage, incomplete spraying due to the entrainment of bubbles from the nozzle 2 for the liquid discharge can be prevented and a large amount of spraying can be secured by simultaneously fulfilling the three of the above described ratio of the inlet hole aperture to the nozzle hole aperture, the ratio of the nozzle hole to the nozzle thickness and the second starting discharge voltage.

It should be noted that a discharge whose discharge time constant is large, i.e., a suction which is slowly performed occupies most of all suction steps in the case where the second starting discharge voltage is equal to or less than 35%, although suction itself is securely performed, an amount of suction per unit time period is not take large, liquid discharge period cannot be shortened as a result, a large amount of liquid discharge cannot be secured, and if suction time is taken smaller in the situations of the range of the first discharge time constant being larger than that of the second discharge time constant so as to take a large amount of suction per unit time period, incomplete liquid discharge will occur because starting of suction is unstable. Moreover, in the case where the second starting discharge voltage is equal to or more than 70%, since the rate of discharge whose discharge time constant is large, i.e., suction which is slowly performed is too small, the starting of suction of the liquid cannot be rapidly performed, the entrainment of bubbles within the nozzle for the liquid discharge will occur and spaying will be unstable by reducing an amount of suction of the liquid from the liquid inlet hole into the liquid pressurized room following the liquid discharge.

Then, it will be good that a time for discharging with the second discharge time constant T4 is made ranged from equal to or more than one fourth of specific vibration period T to equal to or less than 20 fold of specific vibration period T at the time the liquid is supplied into the channel path of structure consisted of the nozzle for liquid discharge, the pressurized room for pressurizing the liquid discharged from this nozzle, the inlet hole supplying the liquid into the relevant pressurized room and the piezoelectric\electrostriction element making pressurized room pressurize and operate and the ratio of the initial discharge time T3 to the second discharge time T4, T3/T4 is made 0.1–20. By defining them in these ranges, liquid supply from the inlet hole can be smoothly performed with respect to suction speed, and discharge operation can be performed quite well without an invasion of any bubble from the nozzle hole into the pressurized room. Moreover, specific vibration period in the present invention ranges from 5 μ sec to 40 μ sec.

In the case where a time T4 is equal to or less than T\4, since suction speed is too high, even if the initial first discharge is performed well, the liquid supply from the inlet hole performed by suction operation during the second discharge is insufficient, and incomplete spraying will occur by invasion of bubbles from the nozzle hole into the pressurized room. Moreover, in the case where a time T4 is equal to or more than 20 T, an amount of suction per unit time period is not taken large, the liquid discharge period cannot be shortened as a result, and a large amount of liquid discharge cannot be secured.

Moreover, in the case where the ratio T3/T4 is made equal to or less than 0.1, since the rate of initial discharge whose discharge time constant is large is smaller, the ratio of liquid suction during the initial discharge is decreased with respect to the whole amount of suction, suction during the second discharge is insufficient in time, it tends to be incomplete spraying, in the case where the ratio T3/T4 is made equal to or more than 20, since an effect due to the setting of the second discharge time constant is lowered, in the viewpoint of a large amount of spraying, an effect due to the raise of a drive frequency will be much more effective means.

It should be noted that discharge time constant for the liquid supply is changed by two steps, however, it is preferable to set discharge time constant by more than 2 steps and gradually larger. Moreover, other than a method of deforming the pressurized room by charging the piezoelectric\electrostriction element for carrying out liquid-drop discharge, a method of deforming the pressurized room by discharging from the piezoelectric\electrostriction element for carrying out liquid-drop discharge can be performed.

Figure 3:
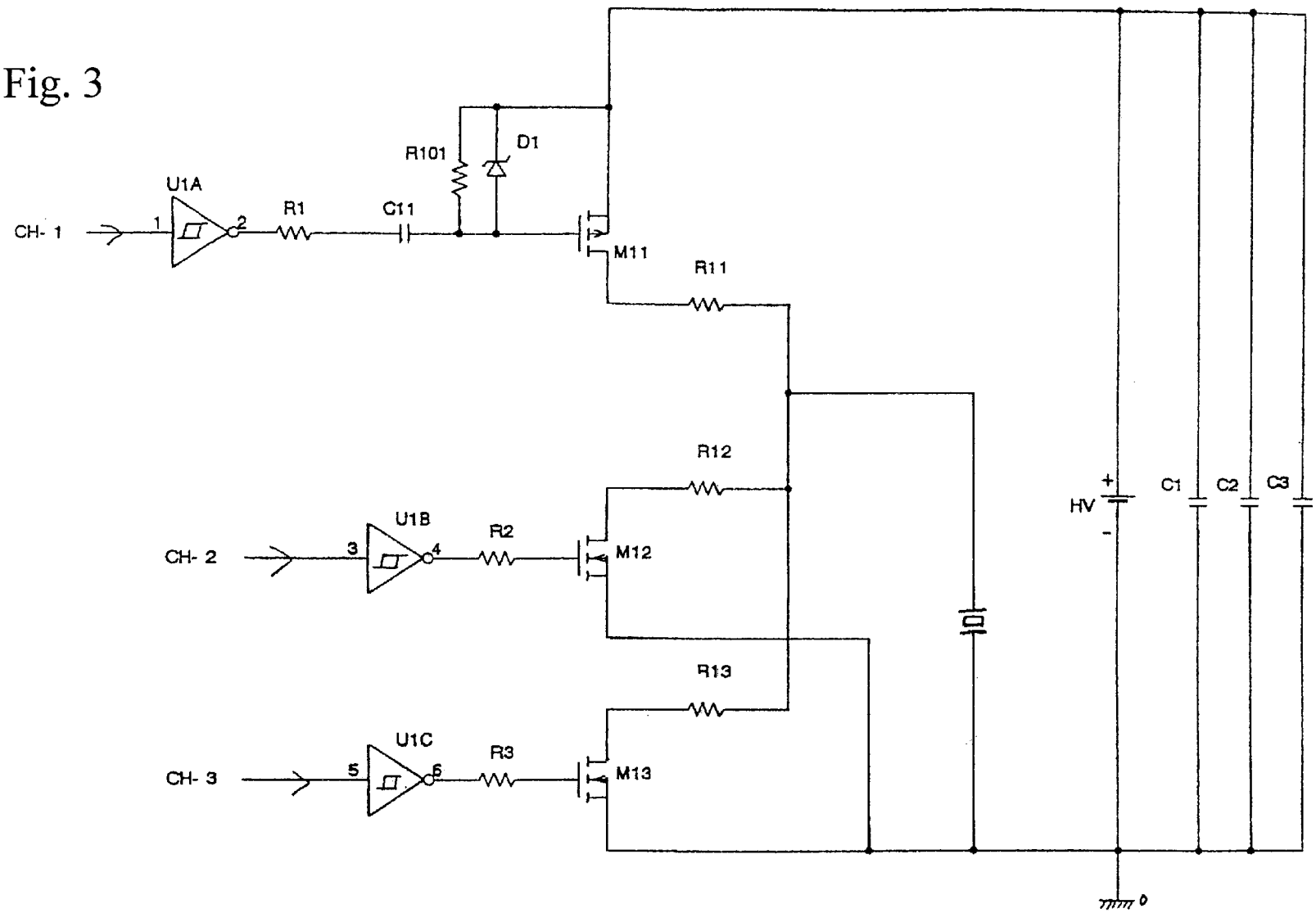
FIG. 3 is a diagram of a drive electronics of a piezoelectric\electrostriction element.

FIG. 3 shows a circuit diagram of a drive electronics supplying application voltage signals of FIG. 2(*a*), and the presence or absence of control signal outputted from the drive electronics is shown in FIG. 2(*b*). In CH 1, a charge signal which is an OFF signal when a liquid is discharged is inputted, in CH 2 upon the initial fall time T3, in CH 3 upon the second fall time T4, ON signals are inputted as the first discharge signal and the second discharge signal, respectively. In the diagram of FIG. 3, U1A, U1B and U1C are Schmit trigger ICs, R1, R2 and R3 are resistances for use in output current value restriction of Schmit trigger ICs, C11 is a Hi-pass filter for which R101 generates P-MOS driving waveform, M11 is a charge switch consisted of P-MOS, M12, M13 is the first and the second discharge switch consisted of N-MOS, respectively, R11 is resistance for time constant setting during charge, R12, R13 are resistants for discharge time constant setting, $C_D$ is piezoelectric body capacity value, and HV is a voltage generated by direct current source or DC, DC converter.

Then, the charge switch M11 and the resistance R11 form a charge circuit, the first discharge switch M12 and the resistance R12 form the first discharge circuit, the second discharge switch M13 and the resistance R13 form the second discharge circuit. According to these, since time constant of a time T1, T3, T4 of FIG. 2(*a*) is determined by $C_D$×R11, $C_D$×R12, $C_D$×R13, respectively, when time constant setting is changed for use in a liquid-drop device, these resistance values of R11–R13 are changed, therefore, a drive waveform discharging in a desired way and at the lower price can be set.

It should be noted that although in the above described mode for carrying out, a form of discharging liquid-drop during charging the piezoelectric\electrostriction element is shown, in a form of discharging liquid-drop during charge, similar effect can be obtained by making circuit constitution of charge circuit and discharge circuit in reverse and providing two switches, the first charge switch and the second charge switch, as charge switches.

Moreover, although the above described mode for carrying out is a constitution of analogue discharge circuit, a drive waveform can be preferably set by generating a drive waveform with digital signal and converting it into analogue signal, and Schmit trigger IC can be controlled well by a microcomputer.

Figure 5A:
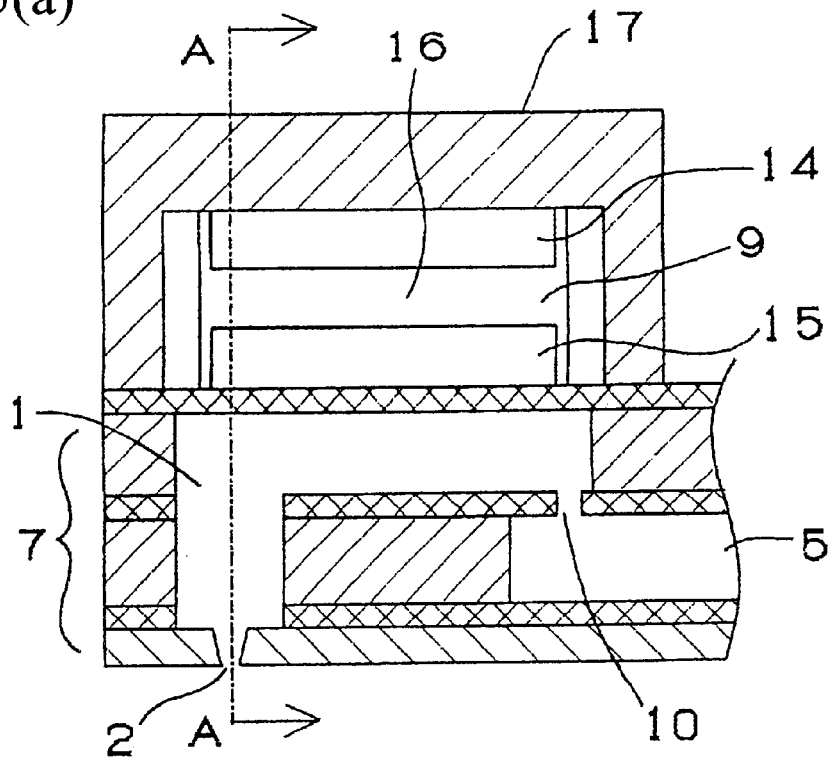
FIG. 5 shows another form of a liquid-drop discharge unit, FIG. 5(*a*) is an illustration showing a vertical sectional view in center, and FIG. 5(*b*) is a sectional view taken in the direction of the arrows substantially along the line A—A of FIG. 5(*a*).
Figure 5B:
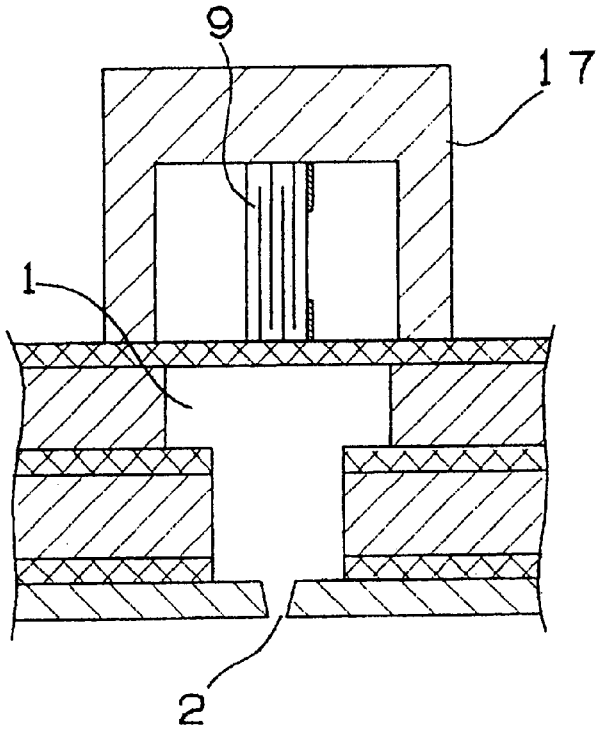

FIG. 5 is an illustration in which a liquid-drop discharge unit for discharging a liquid-drop is taken concrete shape using MLP (multiplayer actuator) instead of a piezoelectric\electrostriction element by deforming the pressurized room when discharging contrary to the action of the above described mode for carrying out, FIG. 5(*a*) shows a vertical sectional view, FIG. 5(*b*) shows a sectional view taken in the direction of the arrows substantially along the line A—A. In this Figure, the reference numeral 17 denotes a fixing member for fixing a piezoelectric\electrostriction element, the reference numeral 14 denotes+electrode, the reference numeral 15 denotes -electrode, and the reference numeral 16 denotes a piezoelectric\electrostriction element. It should be noted that the same reference numerals are attached to the same constituting members with those of the above described FIG. 1.

In the case of this form, it will be good that the ratio of the inlet hole aperture to the nozzle hole aperture and the ratio of the nozzle hole aperture to the nozzle thickness are made as similar as those of the above described mode for carrying out and the second starting charge voltage is made 30–65% of voltage difference between final discharge voltage and starting discharge voltage making the final discharge voltage as a reference. Moreover, it will be good that a time T40 for discharging with the second discharge time constant is made ranged from equal to or more than one fourth of the above described specific vibration period T to equal to or less than 20 fold of it and the ratio T30/T40 of the charging time with the initial charge time constant T30 to the second charge time constant T40 is made ranged from 0.1 to 20 in a similar manner to the above described mode for carrying out.

In this manner, it is preferable so that a stable liquid discharge can be performed without producing air bubbles in the liquid of the liquid pressurized room as well as an amount of liquid supply per unit time period is increased, then after discharging liquid-drop, the time interval for applying a predetermined voltage signal to the piezoelectric\electrostriction element without entrainment of bubbles from the nozzle can be shortened and an amount of liquid supply can be increased by making charge time constant large at the time of starting charge when liquid level vibration in the nozzle for liquid discharge remains, starting suction of liquid at the rate of slower pressure variation and consequently rapidly charging with the second charge time constant.

What is claimed is:

1. A method of driving a liquid-drop spraying device, comprising the steps of:

providing a liquid-drop spraying device comprising a plurality of adjacent liquid-drop discharge units each having a nozzle for discharging liquid, a pressure chamber for pressurizing liquid to be discharged from a respective nozzle, an inlet hole for supplying liquid to said pressure chamber and a piezoelectric\electrostriction element to pressurize and operate said pressure chamber, wherein said inlet holes of each of said liquid-drop discharge units are connected to a common liquid supply path, and wherein a ratio of an aperture of said inlet hole to an aperture of said nozzle is in a range of 0.6 to 1.6 and a ratio of said nozzle aperture to a nozzle thickness is in a range of 0.2 to 4;

applying a predetermined voltage signal, beginning from a starting charge voltage, to each said piezoelectric\electrostriction element to charge said piezoelectric\electrostriction element and deform a wall portion of a respective pressure chamber such that liquid supplied to said respective pressure chamber is discharged from said nozzle due to the pressure produced in said respective pressure chamber;

holding a final charging voltage applied to said piezoelectric\electrostriction element for a predetermined time;

sequentially performing first and second discharging steps with at least two discharge time constants, wherein an initial discharge time constant is larger than a second discharge time constant; and starting said second discharging step at a voltage that is 35 to 70% of a voltage difference between said starting charge voltage and said final charge voltage.

2. The method of claim 1, wherein a time (T4) ranging from a time when a piezoelectric\electrostriction element starts to discharge with the second discharge time constant to a time when said starting voltage is again applied to said piezoelectric\electrostriction element is in a range of one fourth of a specific vibration period, T, to 20 T when liquid is supplied into a channel path defined by said nozzle, said pressure chamber and said inlet hole, and a ratio of a time (T3) for discharging with the initial discharge time constant to said time (T4) is in a range of 0.1 to 20.

3. A method of driving a liquid-drop spraying device, comprising the steps of:

providing a liquid-drop spraying device comprising a plurality of adjacent liquid-drop discharge units each having a nozzle for discharging liquid, a pressure chamber for pressurizing liquid to be discharged from a respective nozzle, an inlet hole for supplying liquid to said pressure chamber and a piezoelectric\electrostriction element to pressurize and operate said pressure chamber, wherein said inlet holes of each of said liquid-drop discharge units are connected to a common liquid supply path, and wherein a ratio of an aperture of said inlet hole to an aperture of said nozzle is in a range of 0.6 to 1.6 and a ratio of said nozzle aperture to a nozzle thickness is in a range of 0.2 to 4;

discharging current from each said piezoelectric/electrostrictive element to deform a wall portion of a respective pressure chamber such that liquid supplied to said respective pressure chamber is discharged from said nozzle due to the pressure produced in said respective pressure chamber;

holding a final discharging voltage for a predetermined time;

sequentially performing first and second charging steps with a least two charge time constants, to reach a final charging voltage, wherein an initial charge time constant is larger than a second charge time constant; and starting said second charging step at a voltage that is 30 to 65% of a voltage difference between said final charging voltage and said final discharging voltage.

4. The method of claim 3, wherein a time (T4) ranging from a time when a piezoelectric/electrostrictive element starts charging with the second charge time constant to a time when said piezoelectric/electrostrictive element begins to discharge current is in a range of one fourth of a specific vibration period, T, to 20 T when liquid is supplied into a channel path defined by said nozzle, said pressure chamber and said inlet hole and a ratio of a time (T3) for charging with the initial charge time constant to said time (T4) is in a range of 0.1 to 20.

* * * * *